US007798670B2

(12) United States Patent
Kinnune

(10) Patent No.: US 7,798,670 B2
(45) Date of Patent: Sep. 21, 2010

(54) POWER SUPPLY MOUNTING APPARATUS FOR LIGHTING FIXTURE

(75) Inventor: Brian Kinnune, Racine, WI (US)

(73) Assignee: Ruud Lighting, Inc., Racine, WI (US)

( * ) Notice: Subject to any disclaimer, the term of this patent is extended or adjusted under 35 U.S.C. 154(b) by 347 days.

(21) Appl. No.: 11/963,092

(22) Filed: Dec. 21, 2007

(65) Prior Publication Data

US 2009/0086472 A1 Apr. 2, 2009

Related U.S. Application Data

(63) Continuation-in-part of application No. 11/864,300, filed on Sep. 28, 2007, now Pat. No. 7,637,642.

(51) Int. Cl.
*F21S 4/00* (2006.01)

(52) U.S. Cl. ..... 362/217.1; 362/294

(58) Field of Classification Search ..... 362/217.1, 362/217.17, 640, 648, 373, 547
See application file for complete search history.

(56) References Cited

U.S. PATENT DOCUMENTS 5,918,842 A 7/1999 Garfinkle
6,158,882 A * 12/2000 Bischoff, Jr. ..... 362/488
6,679,461 B1 1/2004 Hawkins
6,776,504 B2 * 8/2004 Sloan et al. ..... 362/240
6,882,111 B2 4/2005 Kan et al.
7,163,328 B2 1/2007 Chang et al.
7,513,659 B2 * 4/2009 Vukosic et al. ..... 362/294
7,559,672 B1 * 7/2009 Parkyn et al. ..... 362/244

FOREIGN PATENT DOCUMENTS

WO WO 02/16826 2/2002

* cited by examiner

*Primary Examiner*—Ali Alavi
(74) *Attorney, Agent, or Firm*—Jansson Shupe & Munger Ltd.

(57) ABSTRACT

A lighting fixture including a housing having a chamber defined by a surrounding wall, at least one power-supply unit within the chamber, and a slidable interlock securing the power-supply unit to the surrounding wall. The interlock includes a linear groove on one of the power-supply unit and the wall, and a mating projection on the other of the power-supply unit and the wall and slidably receivable into the groove. The power-supply unit is readily securable within the chamber by slidable engagement with the surrounding wall. It is preferred that the power-supply unit be secured closely against the fixture-exterior wall-portion, thus facilitating heat transfer from the power-supply unit to outside the fixture.

21 Claims, 19 Drawing Sheets

POWER SUPPLY MOUNTING APPARATUS FOR LIGHTING FIXTURE

RELATED APPLICATIONS

This application is a continuation-in-part of currently pending U.S. application Ser. No. 11/864,300, filed on Sep. 28, 2007, the contents of which are incorporated herein by reference.

FIELD OF THE INVENTION

This invention relates to lighting fixtures and, more particularly, to power supply mounting within lighting fixtures using LED modules.

BACKGROUND OF THE INVENTION

In recent years, the use of light-emitting diodes (LEDs) for various common lighting purposes has increased, and this trend has accelerated as advances have been made in LEDs and in LED arrays, often referred to as "LED modules." Indeed, lighting applications which previously had been served by fixtures using what are known as high-intensity discharge (HID) lamps are now beginning to be served by fixtures using LED-array-bearing modules. Such lighting applications include, among a good many others, roadway lighting, factory lighting, parking lot lighting, and commercial building lighting.

Among the leaders in development of LED-array modules is Philips Lumileds Lighting Company of Irvine, Calif. Work continues in the field of LED module development, and also in the field of using LED modules for various lighting fixtures in various applications. It is the latter field to which this invention relates.

Floodlights using LED modules as light source for various applications present particularly challenging problems in fixture development, particularly when floodlight mounting locations and structures will vary. Among other things, placement of the electronic LED power units (LED drivers) for lighting fixtures using LED arrays can be particularly problematic. In some cases, keeping such electronic LED drivers in a water/air-tight location may not be difficult, but if mounting locations and structures vary, then location and protection of such components becomes difficult and adds development costs and potential problems. Lighting-fixture adaptability is an important goal for LED floodlights that are often presented and mounted in different ways.

Heat dissipation is another problem for LED floodlights. And, the goals of dealing with heat dissipation and protection of electronic LED drivers can often be conflicting, contrary goals.

In short, there is a significant need in the lighting industry for improved floodlight fixtures using modular LED units—fixtures that are adaptable for a wide variety of mountings and situations, and that satisfy the problems associated with heat dissipation and appropriate protection of electronic LED driver components. Finally, there is a need for an improved LED-module-based floodlight which is easy and inexpensive to manufacture.

OBJECTS OF THE INVENTION

It is an object of the invention to provide an improved lighting fixture that overcomes some of the problems and shortcomings of the prior art, including those referred to above.

Another object of the invention is to provide an improved lighting fixture that provides for easy and secure mounting of a power supply unit.

Another object of the invention is to provide an improved lighting fixture that reduces development and manufacturing costs of lighting fixtures for different applications.

Another object of the invention is to provide an improved LED lighting fixture with excellent protection of the electronic LED drivers needed for such products.

Still another object of the invention is to provide an improved LED lighting fixture with both good protection of electronic LED drivers and excellent heat dissipation.

How these and other objects are accomplished will become apparent from the following descriptions and the drawings.

SUMMARY OF THE INVENTION

The present invention is an improvement in LED floodlight fixtures. The inventive lighting fixture includes a housing having a chamber defined by a surrounding wall, at least one power-supply unit within the chamber, and a slidable interlock securing the power-supply unit to the surrounding wall. The interlock includes a linear groove on one of the power-supply unit and the wall and a mating projection on the other of the power-supply unit and the wall and slidably receivable into the groove. Thus, the power-supply unit is readily securable within the chamber by slidable engagement with the surrounding wall.

In the most preferred embodiments of the invention, the groove has an inner cross-dimension greater than its opening cross-dimension; and the projection has a distal portion of cross-sectional dimension greater than the groove opening cross-dimension and not greater than the groove inner cross-dimension. The groove-projection interlock can be of any suitable shapes and configurations which securely hold the power-supply unit with respect to the wall. C-clamp and dove-tail interlocks can be examples of such groove-projection interlock configurations.

In most highly preferred embodiments, the surrounding wall has at least one fixture-exterior wall-portion. The power-supply unit is preferably secured closely against the fixture-exterior wall-portion, thus facilitating heat transfer from the power-supply unit to outside the fixture. It is highly preferred that the surrounding wall be entirely exterior except for wall-portions immediately adjacent to and secured with respect to the rest of the fixture housing. In such cases, the power-supply unit is secured such that the heat is dissipated in a direction away from the rest of the fixture housing.

In some embodiments of this invention, the surrounding wall further defines a chamber-access opening through which the power-supply unit is slidably positioned into the chamber for secure mounting to the surrounding wall.

Preferred embodiments of the inventive lighting fixture further include a mounting member affixed to the power-supply unit. In such embodiments, either the linear groove or the mating projection is on the mounting member. Thus, the power-supply unit is secured to the surrounding wall by the mounting member.

In some highly preferred cases of such embodiment, the mounting member is a heat sink having a first surface affixed closely against the power-supply unit. Either the linear groove or the mating projection is on a second surface of the heat sink. The second surface is secured closely against the fixture exterior wall-portion, thus transferring heat from the power-supply unit outside the fixture.

In the most highly preferred embodiments of the inventive lighting fixture, the chamber is substantially water/air-tight.

Such fixture is preferably an LED lighting fixture with the power-supply unit being an electronic LED driver. The LED fixture preferably includes an LED assembly secured with respect to the housing adjacent thereto in non-water/air-tight condition. The LED assembly preferably has at least one LED-array module mounted on an LED heat sink.

Is the embodiments described immediately above, the surrounding wall has a plurality of wall-portions, including an LED-assembly-adjacent wall-portion which defines a water/air-tight wire-access(s) receiving wires from the LED assembly into the chamber. It is highly preferred that the power-supply unit be secured to a wall-portion opposite the LED-assembly-adjacent wall-portion allowing a sufficient wire-manipulation space between the power-supply unit and the wire-access(s). The power-supply unit is preferably secured to a fixture-exterior wall-portion transferring heat from the power-supply unit outside the fixture.

In preferred embodiments of the inventive LED lighting fixture, the housing includes at least two structures, including a first structure forming a first portion of the chamber receiving wires from the at least one LED-array module. The LED heat sink is interlocked with the first structure. The housing is preferably a perimetrical structure and the water/air-tight chamber substantially surrounds the LED assembly. Such perimetrical structure is preferably substantially rectangular and further includes second, third and fourth structures, all four structures being successively connected to substantially surround the LED assembly.

Another important aspect of the present invention is a method for mounting a lighting-fixture power-supply unit. The method includes the steps of: providing a lighting-fixture housing having a chamber defined by a surrounding wall; providing a slidable interlock including (a) a linear groove on one of the power-supply unit and the wall and (b) a mating projection on the other of the power-supply unit and the wall and slidably receivable into the groove; slidably engaging the linear groove and the mating projection; and securing the power-supply unit within the chamber by the slidable engagement with the surrounding wall.

In the embodiments in which the surrounding wall further defines a chamber-access opening, the slidably engaging step begins at the chamber-access opening. The power-supply unit is slidably positioned into the chamber through the chamber-access opening.

In highly preferred embodiments, the method further includes the steps of providing a mounting member with either the linear groove or the mating projection being thereon; and affixing the mounting member to the power-supply unit.

In such highly preferred embodiments the surrounding wall has at least one fixture exterior wall-portion. The mounting member is a heat sink having a first surface affixed closely against the power-supply unit. Either the linear groove or the mating projection is on a second surface of the heat sink. The second surface is secured closely against the fixture exterior wall-portion, thus transferring heat from the power-supply unit outside the fixture.

In some preferred embodiments the LED lighting fixture is a floodlight in which the housing includes a first border structure forming a first border-portion of the chamber, the first border structure receiving wires from the at least one LED-array module and the LED heat sink being interlocked with the first border structure. The housing further includes a frame structure forming a frame-portion of the chamber secured to the first border structure, the frame structure extending along the LED assembly. It is highly preferred that the border structure is a metal extrusion.

The first border structure preferably has at least one bolt-receiving border-hole through the first border structure, such border-hole being isolated from the first border-portion of the chamber. The frame structure also has at least one bolt-receiving frame-hole through the frame structure, the frame-hole being isolated from the frame-portion of the chamber. Each such one or more frame-holes are aligned with a respective border-hole(s). A bolt passes through each aligned pair of bolt-receiving holes such that the border structures and the frame structure are bolted together while maintaining the water/air-tight condition of the chamber.

In some embodiments, the housing preferably includes a second border structure forming a second border-portion of the chamber, the LED heat sink being interlocked with the second border structure. In such embodiments, the frame structure is secured to the first and second border structures.

The frame structure preferably includes an opening edge about the frame-portion of the chamber. A removable cover-plate is preferably in substantial water/air-tight sealing engagement with respect to the opening edge. Such opening edge may also have a groove configured for mating water/air-tight engagement with the border structure(s). It is preferred that one or more electronic LED drivers are enclosed in the frame-portion of the chamber.

In certain preferred embodiments the frame structure preferably includes a vent permitting air flow to and from the LED assembly. Such venting facilitates cooling the LED assembly.

In certain highly preferred embodiments of this invention, including those used for street lighting and the like, the housing is a perimetrical structure such that the substantially water/air-tight chamber substantially surrounds the LED assembly. The perimetrical structure is preferably substantially rectangular and includes the first and second border structures and a pair of opposed frame structures each secured to the first and second border structures.

In some versions of the inventive LED floodlight fixture, the housing is a perimetrical structure configured for wall mounting and includes the first and second border structures on opposed perimetrical sides and the frame structure secured on a perimetrical side between the border structures.

In such embodiments, each of the first and second border structures preferably has at least one bolt-receiving border-hole therethrough isolated from the first and second border-portion of the chamber, respectively. Each of the frame structures has at least one bolt-receiving frame-hole therethrough isolated from the frame-portion of the chamber, each such frame-holes aligned with respective border-holes of each of the border structures. A bolt is passing through each aligned set of bolt-receiving holes such that the border structures and the frame structures are bolted together while maintaining the water/air-tight condition of the chamber.

In certain highly preferred embodiments of the inventive LED floodlight fixture, the LED assembly includes a plurality of LED-array modules each separately mounted on its corresponding LED heat sink, the LED heat sinks being interconnected to hold the LED-array modules in fixed relative positions. Each heat sink preferably includes a base with a back base-surface, an opposite base-surface, two base-ends and first and second base-sides, a female side-fin and a male side-fin, one along each of the opposite sides and each protruding from the opposite surface to terminate at a distal fin-edge. The female side-fin includes a flange hook positioned to engage the distal fin-edge of the male side-fin of an adjacent heat sink. At least one inner-fin projects from the opposite surface between the side-fins. One of the LED modules is against the back surface.

In some preferred embodiments, each heat sink includes a plurality of inner-fins protruding from the opposite base-surface. Each heat sink may also include first and second lateral supports protruding from the back base-surface, the lateral supports each having an inner portion and an outer portion, the inner portions of the first and second lateral supports having first and second opposed support-ledges, respectively, forming a heat-sink-passageway slidably supporting one of the LED-array modules against the back base-surface. The first and second supports of each heat sink are preferably in substantially planar alignment with the first and second side-fins, respectively. The flange hook is preferably at the distal fin-edge of the first side-fin.

It is highly preferred that each heat sink be a metal extrusion with the back base-surface of such heat sink being substantially flat to facilitate heat transfer from the LED-array module, which itself has a flat surface against the back-base surface.

Each heat sink also preferably includes a lateral recess at the first base-side and a lateral protrusion at the second base-side, the recesses and protrusions being positioned and configured for mating engagement of the protrusion of one heat sink with the recess of the adjacent heat sink.

In certain of the above preferred embodiments, the female and male side-fins are each a continuous wall extending along the first and second base-sides, respectively. It is further preferred that the inner-fins are also each a continuous wall extending along the base. The inner-fins can be substantially parallel to the side-fins.

In highly preferred embodiments, the LED floodlight fixture further includes an interlock of the housing to the LED assembly. The interlock has a slotted cavity extending along the housing and a cavity-engaging coupler which extends from the heat sink of the LED assembly and is received within the slotted cavity.

In some of such preferred embodiments, in each heat sink, at least one of the inner-fins is a middle-fin including a fin-end forming a mounting hole receiving a coupler. In some versions of such embodiments, the coupler has a coupler-head; and the interlock is a slotted cavity engaging the coupler-head within the slotted cavity. The slotted cavity preferably extends along the border structure and the coupler-head extends from the heat sink of the LED assembly.

In preferred embodiments of this invention, the LED floodlight fixture includes a restraining bracket secured to the housing. The bracket has a plurality of projections extending between adjacent pairs of fins of the heat sink, thus to secure the LED assembly. The restraining bracket preferably has a comb-like structure including an elongated body with a spine-portion from which identical side-by-side projections extend in a common plane. Such restraining bracket is configured and dimensioned for the elongated body to be fixedly secured to the housing and the projections to snugly fit in spaces between adjacent heat-sink fins, thus holding heat sink from moving.

The LED floodlight fixture further includes a mounting assembly secured to the housing. The mounting assembly preferably has a pole-attachment portion and a substantially water/air-tight section enclosing electrical connections with at least one wire-aperture communicating with the water/air-tight chamber. The housing is in water/air-tight engagement with the water/air-tight section of the pole-mounting assembly.

In the aforementioned substantially rectangular versions of this invention, in which the perimetrical structure includes a pair of opposed frame structures and a first and second opposed border structures, the second border structure may have two sub-portions with a gap therebetween. The sub-portions each include all of the border-structure elements.

In the mounting assembly of such embodiments, the pole-attachment portion preferably receives and secures a pole. Each wire-aperture communicates with the border-portion chamber of a respective one of the second border-structure sub-portions. The gap between the second border-structure sub-portions accommodates the pole-mounting assembly secured to the LED assembly between the border sub-portions. The second border-structure sub-portion(s) are in water/air-tight engagement with the water/air-tight section of the pole-mounting assembly. The pole-attachment portion preferably includes grooves on its opposite sides, the grooves being configured for mating engagement with end edges of the border-structure sub-portions.

Preferably, the pole-mounting assembly has a mounting plate abutting the LED assembly, and at least one fastener/coupler extends from the mounting plate for engagement with the mounting hole of the middle-fin(s).

In some LED floodlight fixtures of this invention, the frame-portion of the chamber has a chamber-divider across the chamber, such chamber-divider having a divider-edge. The chamber-divider divides the frame-portion of the chamber into an end part and a main part that encloses the electronic LED driver(s). The chamber-divider preferably includes a substantially water/air-tight wire-passage therethrough. The wire-passage is preferably a notch having spaced notch-wall ends that terminate at the divider-edge. A notch-bridge spans the notch to maintain the water/air-tight condition of the chamber. The notch-bridge preferably includes a bridge-portion and a pair of gripping-portions configured for spring-grip attachment to the notch-wall ends. Preferably, the removable cover-plate seals the main part of the frame-portion of the chamber in substantially water/air-tight condition.

In certain embodiments of this invention, including those used for parking-structure lighting and the like, the frame structure is a sole frame structure, and the housing is a substantially H-shaped structure with the sole frame structure secured between mid-length positions of the pair of opposed border structures.

Some of the inventive LED floodlight fixtures include a protective cover extending over the LED assembly and secured with respect to the housing. Such protective cover preferably has perforations permitting air/water-flow therethrough for access to and from the LED assembly.

It is most highly preferred that the LED floodlight fixture has a venting gap between the housing and the LED assembly to permit water/air-flow from the heat sink. The venting gap may be formed by the interlock of the housing to the LED assembly.

The improved LED floodlight fixture of this invention overcomes the problems discussed above. Among other things, the invention provides substantially water/air-tight enclosure of electronic LED drivers inside the fixture, while still accommodating heat-dissipation requirements. And, the fixture of this invention is both adaptable for varying applications and mountings, and relatively inexpensive to manufacture.

The term "perimetrical structure" as used herein means an outer portion of the fixture which completely or partially surrounds remaining portions of the fixture. In certain preferred embodiments, such as those most useful for road-way lighting and the like, the perimetrical structure preferably completely surrounds remaining portions of the fixture. In certain other cases, such as certain wall-mounted floodlight fixtures, the perimetrical structure partially surrounds the remaining portions of the fixture.

DETAILED DESCRIPTION OF PREFERRED EMBODIMENTS

Figure 1:
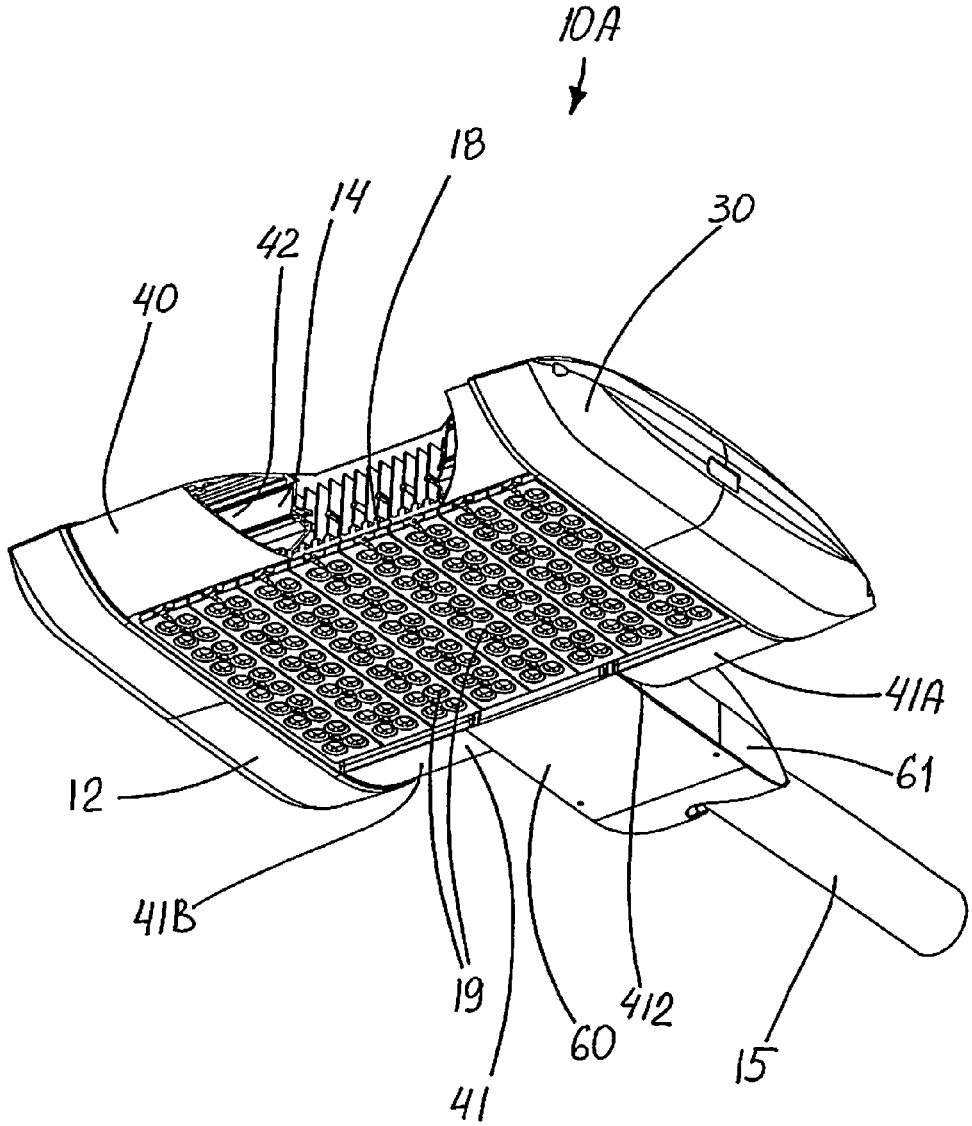
FIG. 1 is a perspective view of an LED floodlight fixture, including a cut-away portion showing an LED assembly.

FIGS. 1-15 illustrate an LED floodlight fixtures 10A-10D. Common or similar parts are given the same numbers in the drawings of both embodiments, and the floodlight fixtures are often referred to by the numeral 10, without the lettering used in the drawings, and in the singular for convenience.

Floodlight fixture 10 includes a housing 12 that forms a substantially water/air-tight chamber 14, at least one electronic LED driver 16 which is enclosed within chamber 14, and an LED assembly 18 that is secured with respect to housing 12 adjacent thereto in non-water/air-tight condition. LED assembly 18 has a plurality of LED-array modules 19 each secured to an LED heat sink 20.

Figure 7:
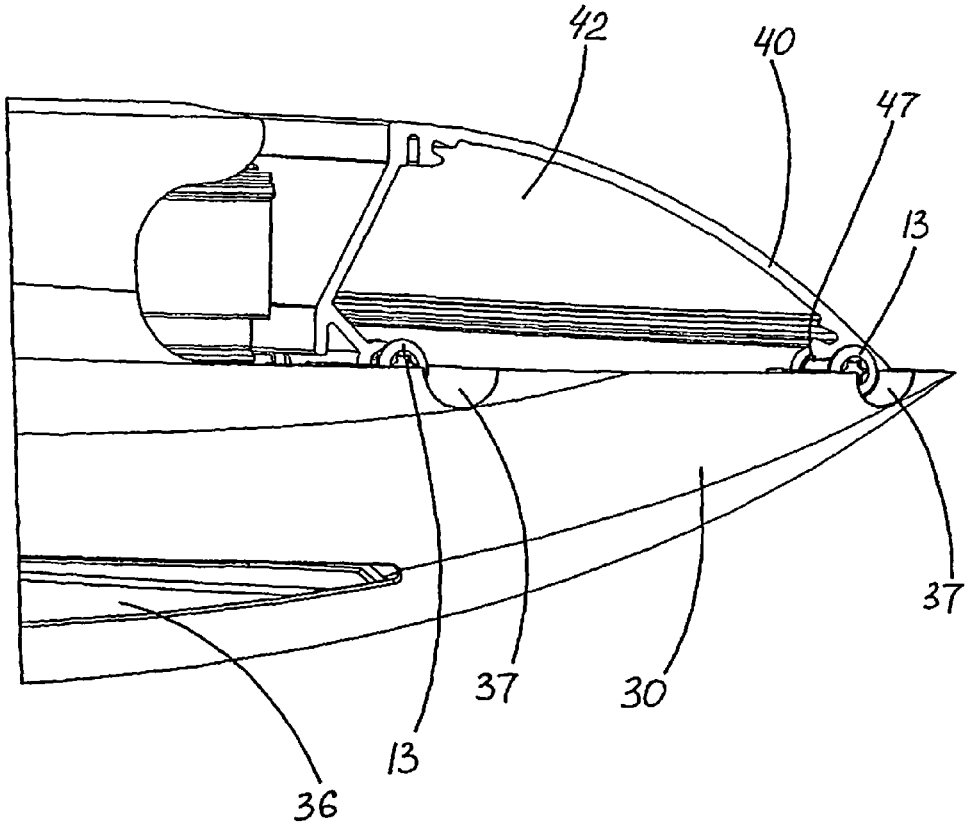
FIG. 7 is another fragmentary perspective view showing the frame structure partially cut-away view to illustrate its being bolted together with the border structure.
Figure 8:
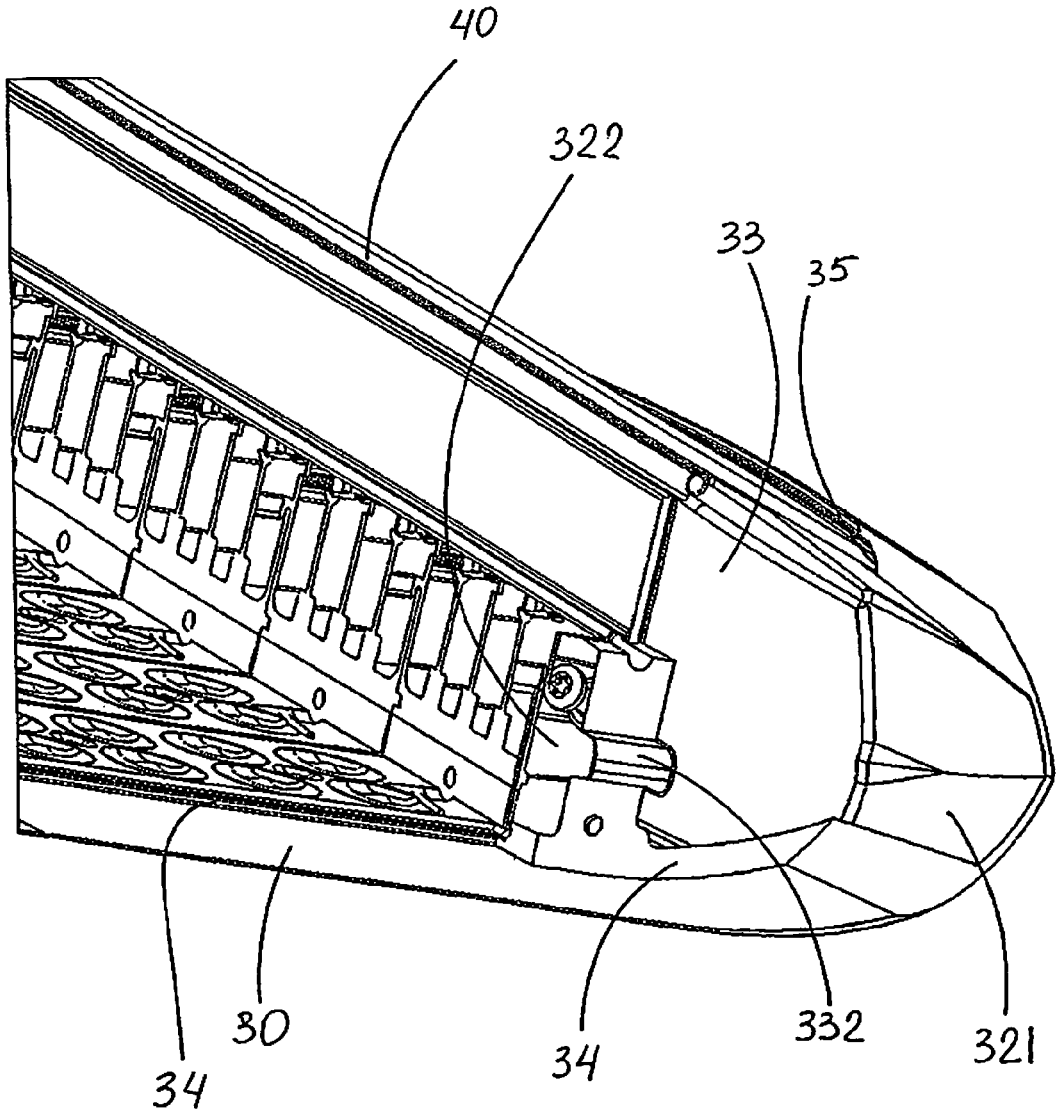
FIG. 8 is another fragmentary perspective view showing the border structure partially cut-away view to illustrates its engagement with the frame structure.

As seen in FIGS. 1-4, 7 and 8, housing 12 includes a frame structure 30 forming a frame-portion 32 of chamber 14 with an opening edge 34 thereabout and a border structure 40 (sometimes referred to as a nose structure 40) secured to frame structure 30 and forming a border-portion 42 (sometimes referred to as nose-portion 42) of chamber 14. As best seen in FIG. 8, opening edge 34 of frame-portion 30 of chamber 14 includes a groove 35 configured for mating water/air-tight engagement with border structure 40. Border structure 40 is an extrusion, preferably of aluminum. FIG. 5 shows electronic LED drivers 16 enclosed in frame-portion 32 of chamber 14.

Figure 6:
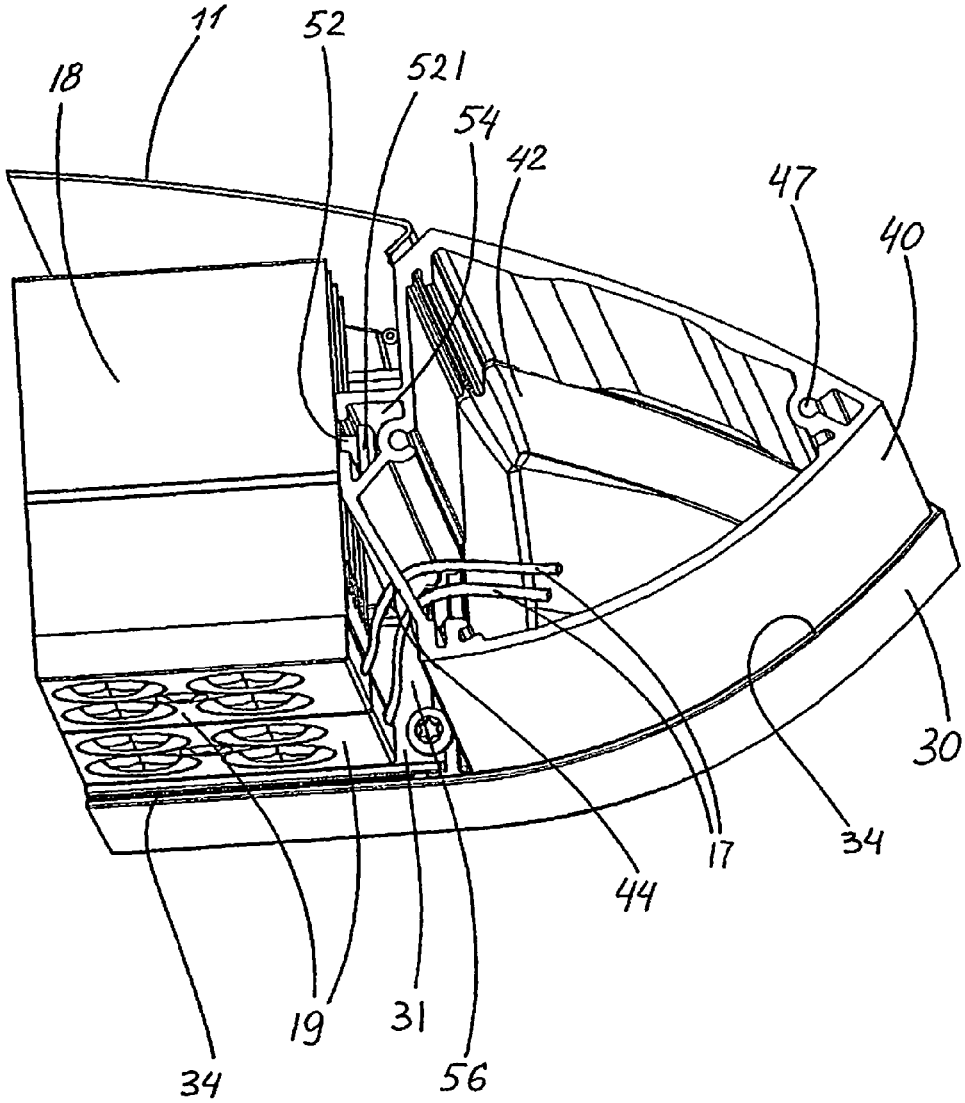
FIG. 6 is an enlarged fragmentary view of the right portion of FIG. 4.

As best seen in FIG. 6, border structure 40 includes substantially water/air-tight wire-accesses 44 for passage of wires 17 between LED assembly 18 and water/ air-tight chamber 14.

FIGS. 2, 3, 5 and 7 show that frame structure 30 includes a vent 36 permitting air flow to and from LED assembly 18. Vent 36 facilitates cooling of LED assembly 18.

As best illustrated in FIGS. 6 and 7, border structure 40 has bolt-receiving border-hole 47 therethrough which is isolated from border-portion 42 of chamber 14. And, frame structure 30 has bolt-receiving frame-holes 37 therethrough which are isolated from frame-portion 32 of chamber 14; frame-hole 37 is aligned with a respective border-hole 47. A bolt 13 passes through aligned pair of bolt-receiving holes 37 and 47 such that border structure 40 and frame structure 30 are bolted together while maintaining the water/air-tight condition of chamber 14.

Figure 3:
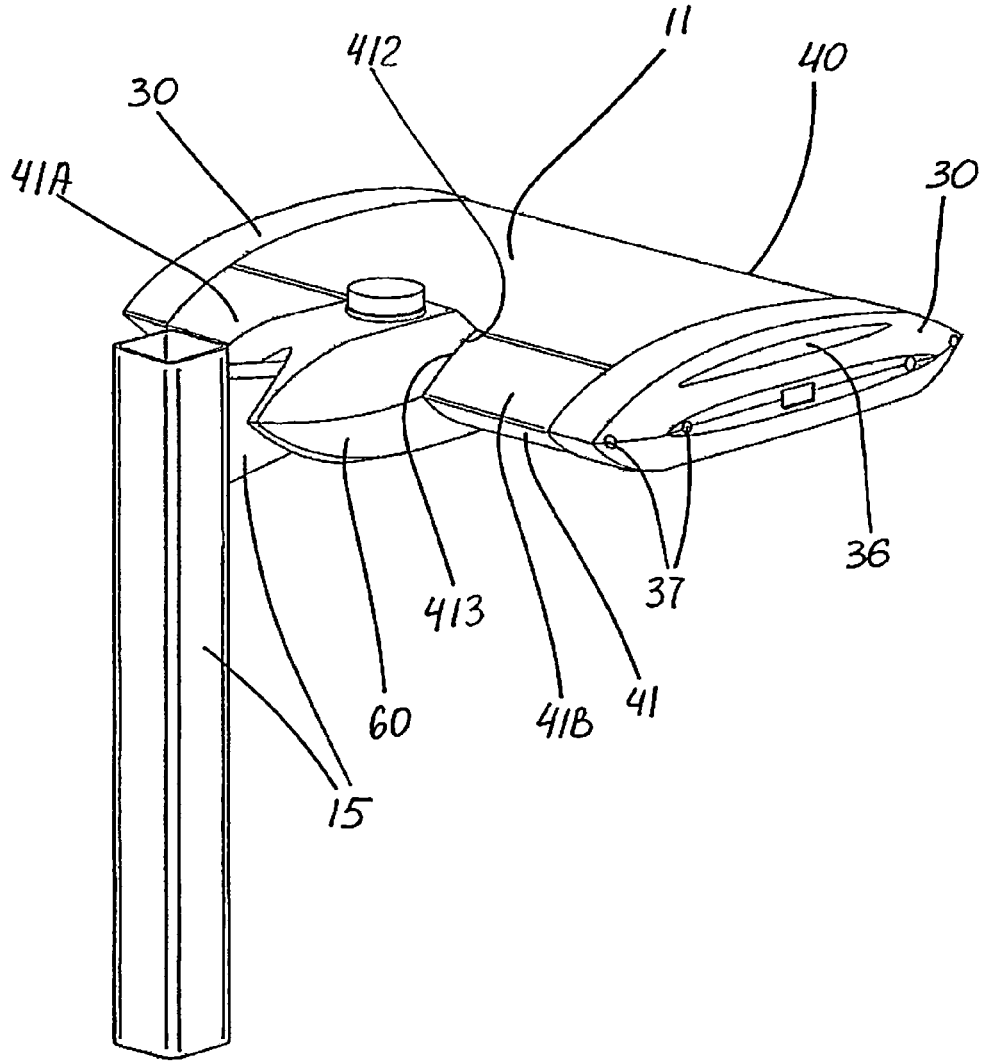
FIG. 3 is a perspective view of another LED floodlight fixture including a pole-mounting assembly on a pole of square cross-section.

FIGS. 1 and 3 best illustrate certain highly preferred embodiments of this invention in which housing 12 is a perimetrical structure which includes a pair of opposed frame structures 30 and a pair of opposed nose structures 40, making perimetrical structure 12 of floodlight fixture 10A substantially rectangular. FIGS. 1, 4-8 and 11 illustrate aspects of inventive LED floodlight fixture 10A.

Figure 10:
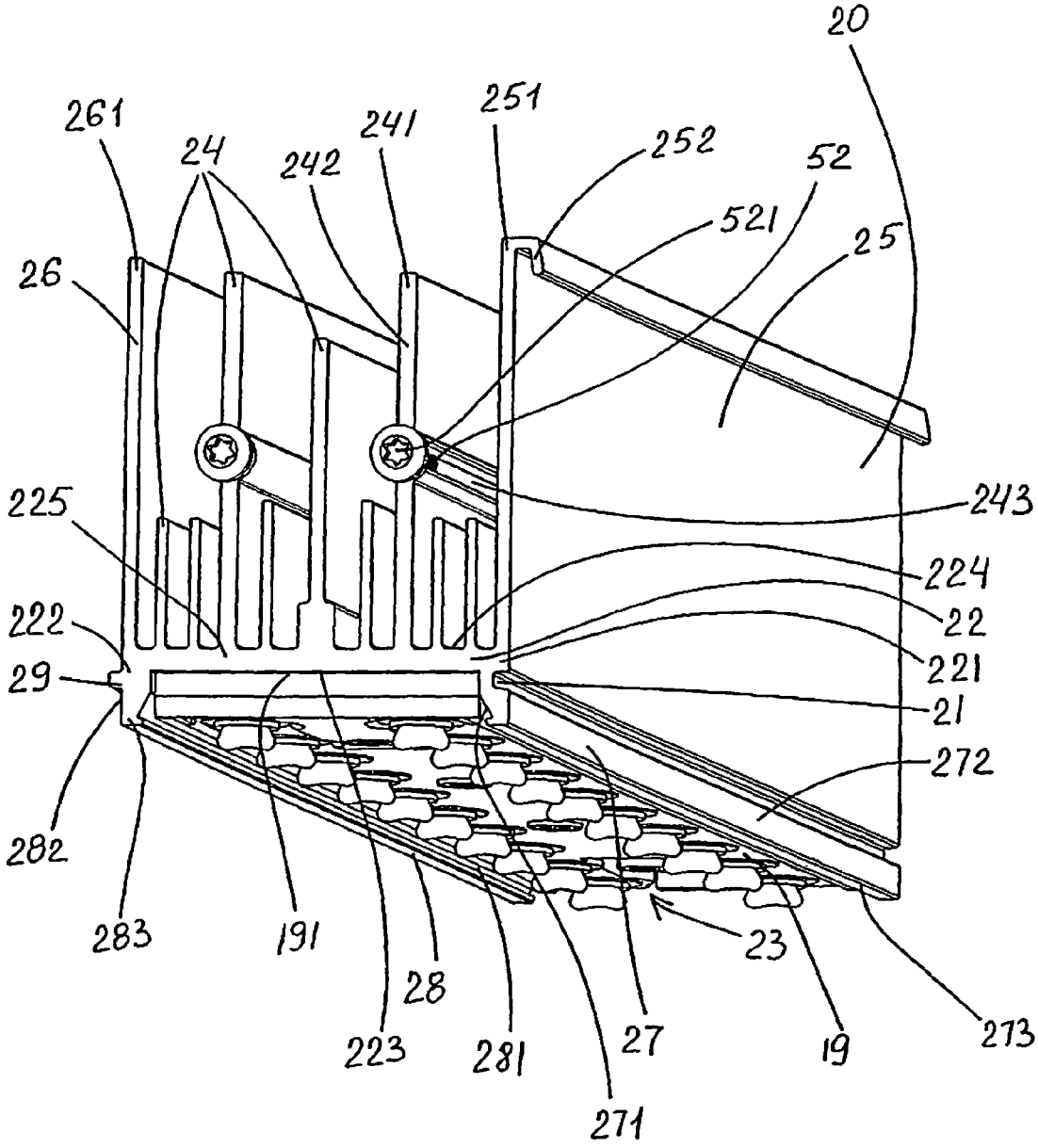
FIG. 10 is an enlarged fragmentary perspective view of one LED-array module LED and its related LED heat sink of the LED assembly of the illustrated LED floodlight fixtures.
Figure 11:
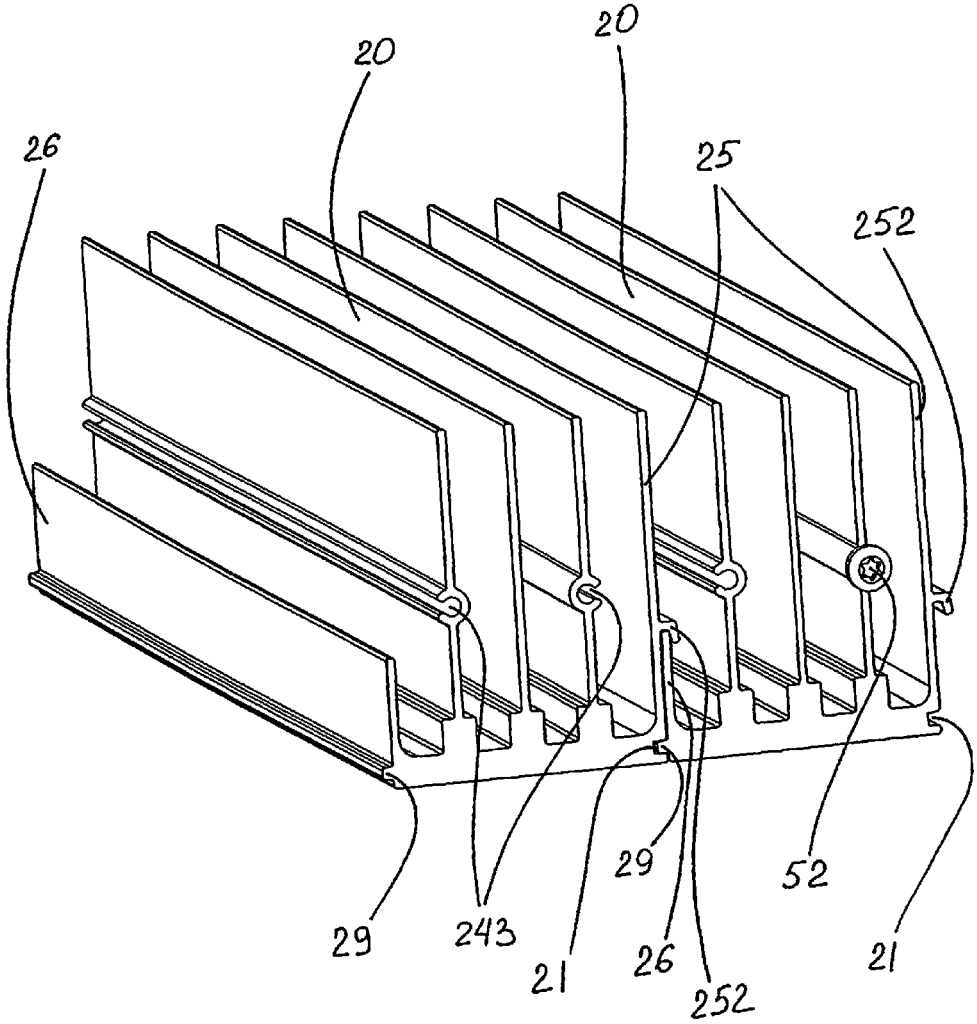
FIG. 11 is an enlarged fragmentary end-wise perspective view of two interconnected LED heat sinks of the LED assembly of the illustrated LED floodlight fixtures.

In LED floodlight fixtures 10, LED assembly 18 includes a plurality of LED-array modules 19 each separately mounted on its corresponding LED heat sink 20, such LED heat sinks 20 being interconnected to hold LED-array modules 19 in fixed relative positions. Each heat sink 20 includes: a base 22 with a back base-surface 223, an opposite base-surface 224, two base-ends 225 and first and second base-sides 221 and 222; a plurality of inner-fins 24 protruding from opposite base-surface 224; first and second side-fins 25 and 26 protruding from opposite base-surface 224 and terminating at distal fin-edges 251 and 261, first side-fin 25 including a flange hook 252 positioned to engage distal fin-edge 261 of second side-fin 26 of adjacent heat sink 20; and first and second lateral supports 27 and 28 protruding from back base-surface 223, lateral supports 27 and 28 each having inner portions 271 and 281, respectively, and outer portion 272 and 282, respectively. Inner portions 271 and 281 of first and second lateral supports 27 and 28 have first and second opposed support-ledges 273 and 283, respectively, that form a heat-sink-passageway 23 which slidably supports an LED-array module 19 against back base-surface 223. First and second supports 27 and 28 of each heat sink 20 are in substantially planar alignment with first and second side-fins 25 and 26, respectively. As seen in FIGS. 10 and 11, the flange hook is at 251 distal fin-edge of first side-fin 25.

Each heat sink 20 is a metal (preferably aluminum) extrusion with back base-surface 223 of heat sink 20 being substantially flat to facilitate heat transfer from LED-array module 19, which itself has a flat surface 191 against back-base surface 223. Each heat sink 20 also includes a lateral recess 21 at first base-side 221 and a lateral protrusion 29 at second base-side 222, recesses 21 and protrusions 29 being positioned and configured for mating engagement of protrusion 29 of one heat sink 20 with recess 21 of adjacent heat sink 20.

As best seen in FIGS. 1, 4, 5, 6, 10 and 11, first and second side-fins 25 and 26 are each a continuous wall extending along first and second base-sides 221 and 222, respectively. Inner-fins 24 are also each a continuous wall extending along base 22. Inner-fins 24 are substantially parallel to side-fins 25 and 26.

Figure 4:
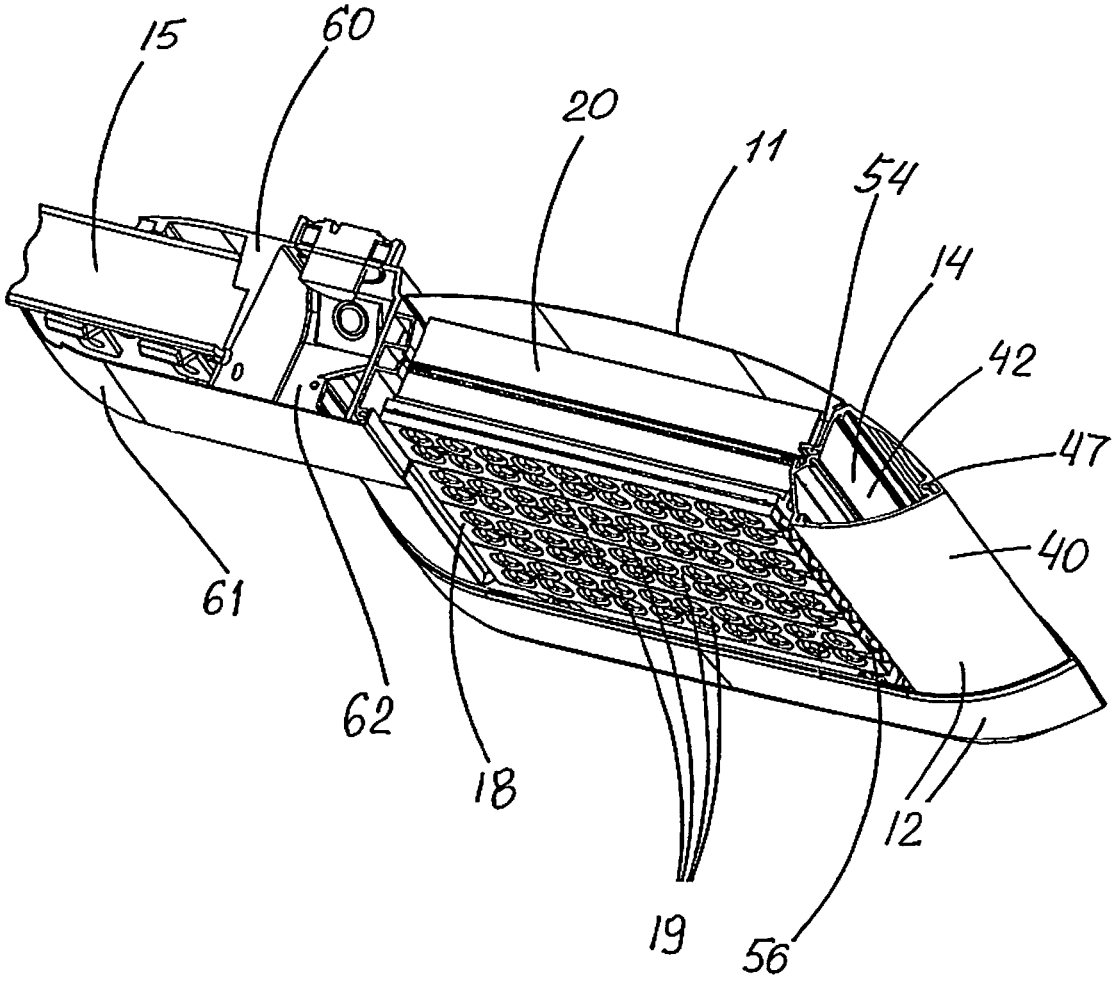
FIG. 4 is a side perspective view of the LED floodlight of FIG. 1 broken away at a middle portion to show interior structure.
Figure 5:
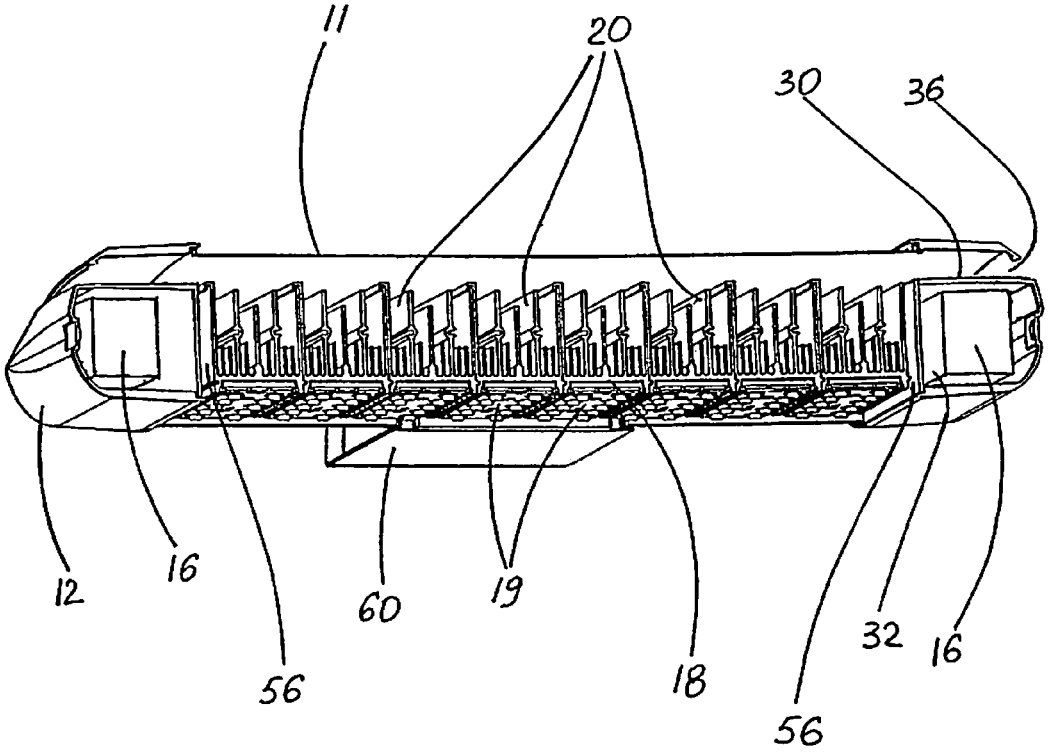
FIG. 5 is a front perspective view of the LED floodlight of FIG. 1 broken away at a middle portion to show interior structure.

FIGS. 4 and 6 show an interlock of housing 12 to LED assembly 18. As best seen in FIGS. 10 and 11, in each heat sink 20 inner-fins 24 include two middle-fins 241 each of which includes a fin-end 242 forming a mounting hole 243. A coupler 52 in the form of screw is engaged in mounting hole 243, and extends from heat sink 20 to terminate in a coupler-head 521. Housing 12 has a slotted cavity 54 which extends along, and is integrally formed with, each of border structures 40 and forms the interlock by receiving and engaging coupler-heads 521 therein.

Figure 2:
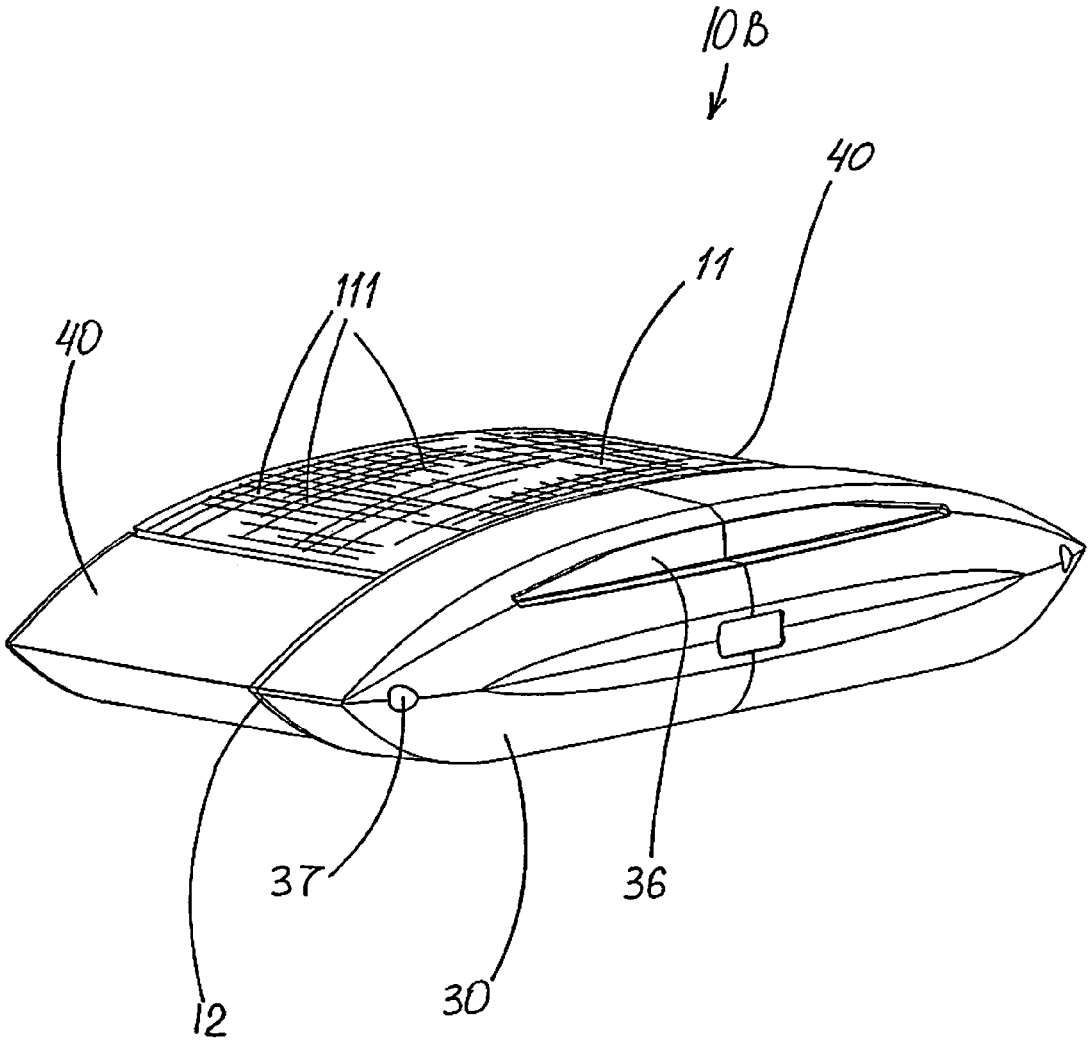
FIG. 2 is a perspective view of the LED floodlight fixture configured for wall mounting.

FIG. 2 illustrates a version of the invention which is LED floodlight fixture 10B. In floodlight fixture 10B, perimetrical structure 12 includes a pair of nose structures 40 configured for wall mounting and one frame structure 30 in substantially perpendicular relationship to each of the two nose structures 40.

The substantially rectangular floodlight fixture 10A which is best illustrated in FIGS. 1, 3 and 4, perimetrical structure 12 includes a pair of opposed frame structures 30 and a pair of opposed first nose structure 40 and second nose structure 41. The second nose structure 41 has two spaced sub-portions 41A and 41B with a gap 412 therebetween. Sub-portions 41A and 41B each include all of the nose-portion elements. Gap 412 accommodates a pole-mounting assembly 60, one embodiment of which is shown in FIGS. 1, 3, 4 and 12, that is secured to LED assembly 18 between nose sub-portions 41A and 41B.

Pole-mounting assembly 60 includes a pole-attachment portion 61 that receives and secures a pole 15 and a substantially water/air-tight section 62 that encloses electrical connections and has wire-apertures 64. Each wire-aperture 64 communicates with nose-portion 42 chamber of a respective one of nose-structure sub-portions 41A and 41B. Nose-structure sub-portions 41A and 41B are in water/air-tight engagement with water/air-tight section 62 of pole-mounting assembly 60. Water/air-tight section 62 includes grooves 621 on its opposite sides 622; grooves 621 are configured for mating engagement with end edges 413 of nose-structure sub-portions 41A and 41B.

Figure 12:
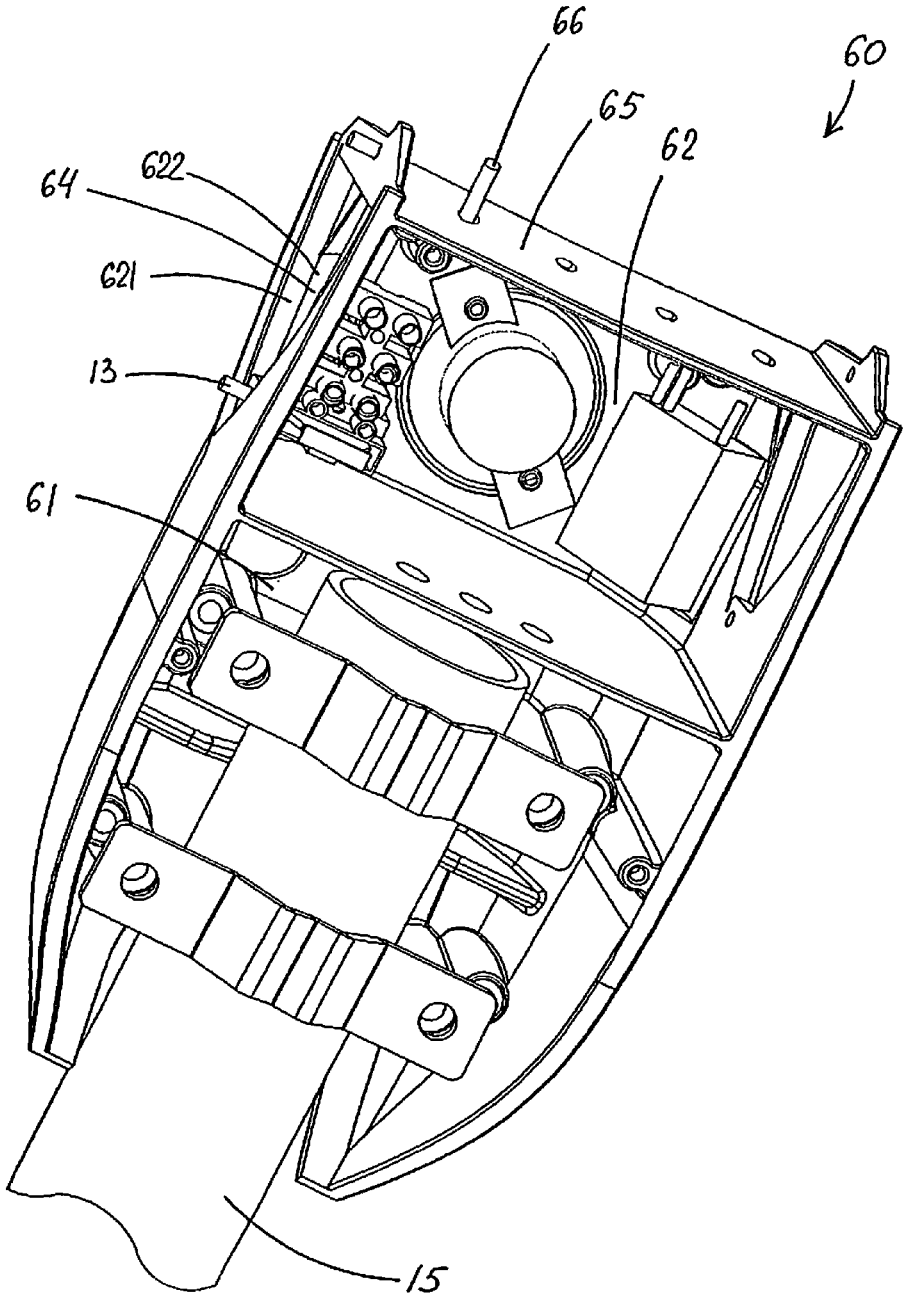
FIG. 12 is an enlarged fragmentary perspective view from below of the pole-mounting assembly engaged with a pole-attachment portion, with the cover of the pole-mounting assembly removed to show internal parts.

As best seen in FIG. 12, pole-mounting assembly 60 has a mounting plate 65 abutting LED assembly 18, and fastener/couplers 66 extend from mounting plate 65 into engagement with mounting hole 243 of middle-fins 241.

Figure 9:
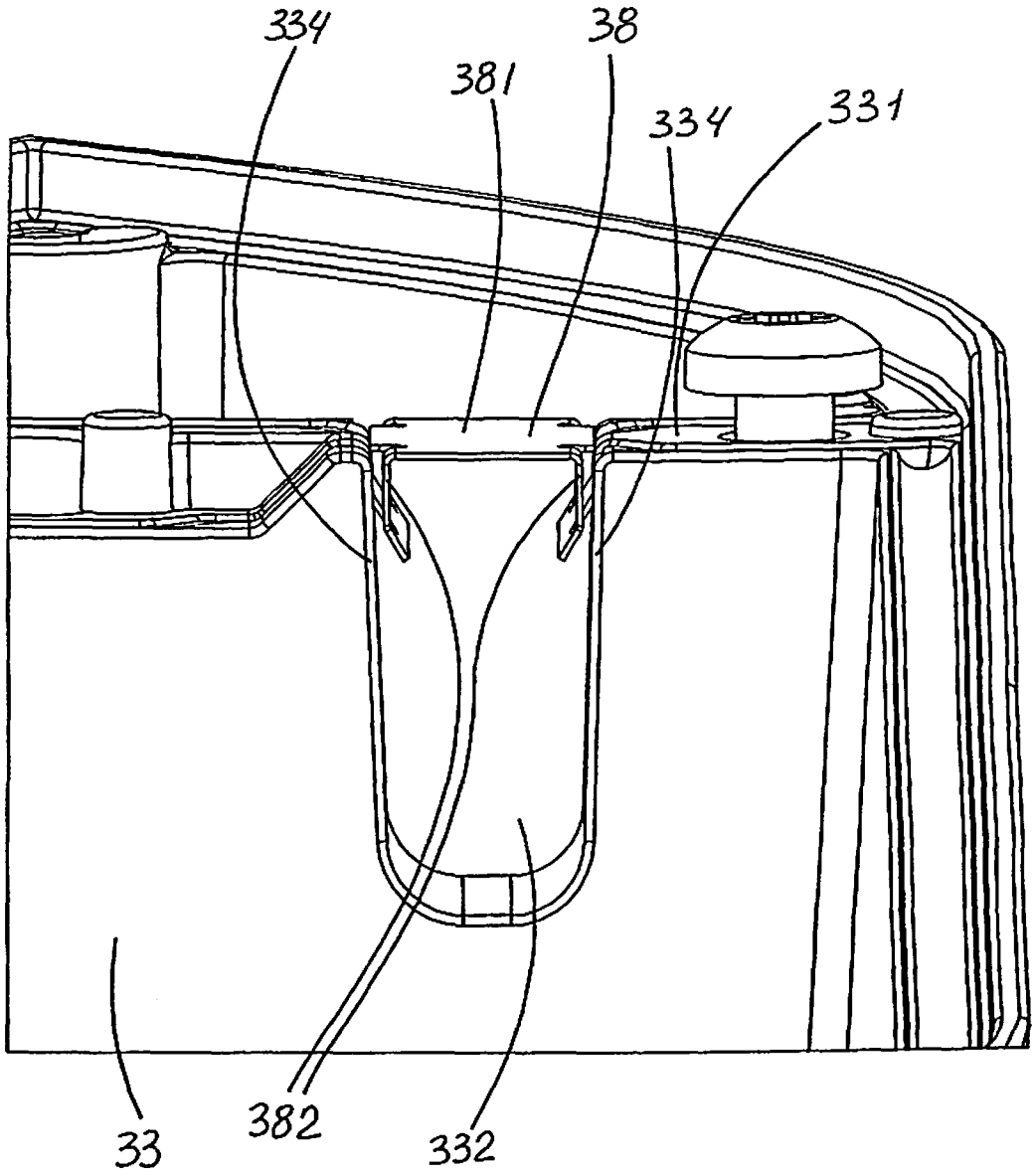
FIG. 9 is a greatly enlarged fragmentary perspective view showing a portion of the chamber-divider wall, the notch therein and the notch-bridge thereover.

FIGS. 8 and 9 show that frame-portion 32 of chamber 14 has a chamber-divider 33 across chamber 32 that divides frame-portion 32 of chamber 14 into an end part 321 and a main part 322, which encloses electronic LED driver(s) 16. Chamber-divider 33 has a divider-edge 331. Chamber-divider 33 includes a substantially water/air-tight wire-passage therethrough in the form of a notch 332 having spaced notch-wall ends 334 that terminate at divider-edge 331. A notch-bridge 38 spans notch 332 to maintain the water/air-tight condition of chamber 32. Notch-bridge 38 includes a bridge-portion 381 and a pair of gripping-portions 382 which are configured for spring-grip attachment to notch-wall ends 334. A removable cover-plate 31 seals main part 322 of frame-portion 32 of chamber 14 in substantially water/air-tight condition.

FIGS. 2-6 show that inventive LED floodlight fixtures 10 include a protective cover 11 that extends over LED assembly 18 and is secured with respect to housing 12. Protective cover 11 has perforations 111 to permit air and water flow therethrough for access to and from LED assembly 18.

As best seen in FIGS. 5 and 6, LED floodlight fixture 10 has a venting gap 56 between housing 12 and LED assembly 18, to permit air and water flow from heat sink 20. Venting gap 56 is formed by the interlock of housing 12 to LED assembly 18 or is a space along outer side-fins of the LED assembly.

Figure 13:
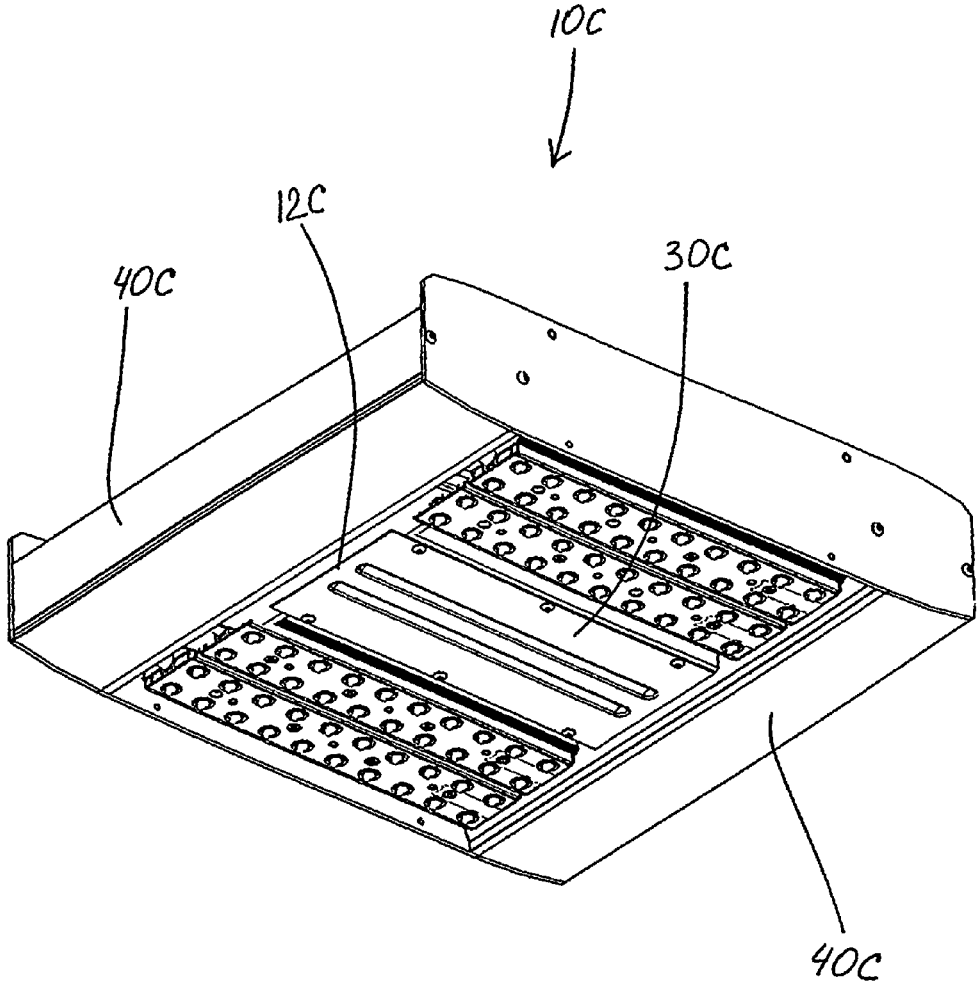
FIG. 13 is a perspective view of the LED floodlight fixture of the type having the housing being a substantially H-shaped structure.

FIG. 13 shows an embodiment of the inventive floodlight fixture 10C in which frame structure 30C is a sole frame structure, and housing 12C is a substantially H-shaped structure with sole frame structure 30C secured between mid-length positions of the pair of opposed border structures 40C.

Figure 14:
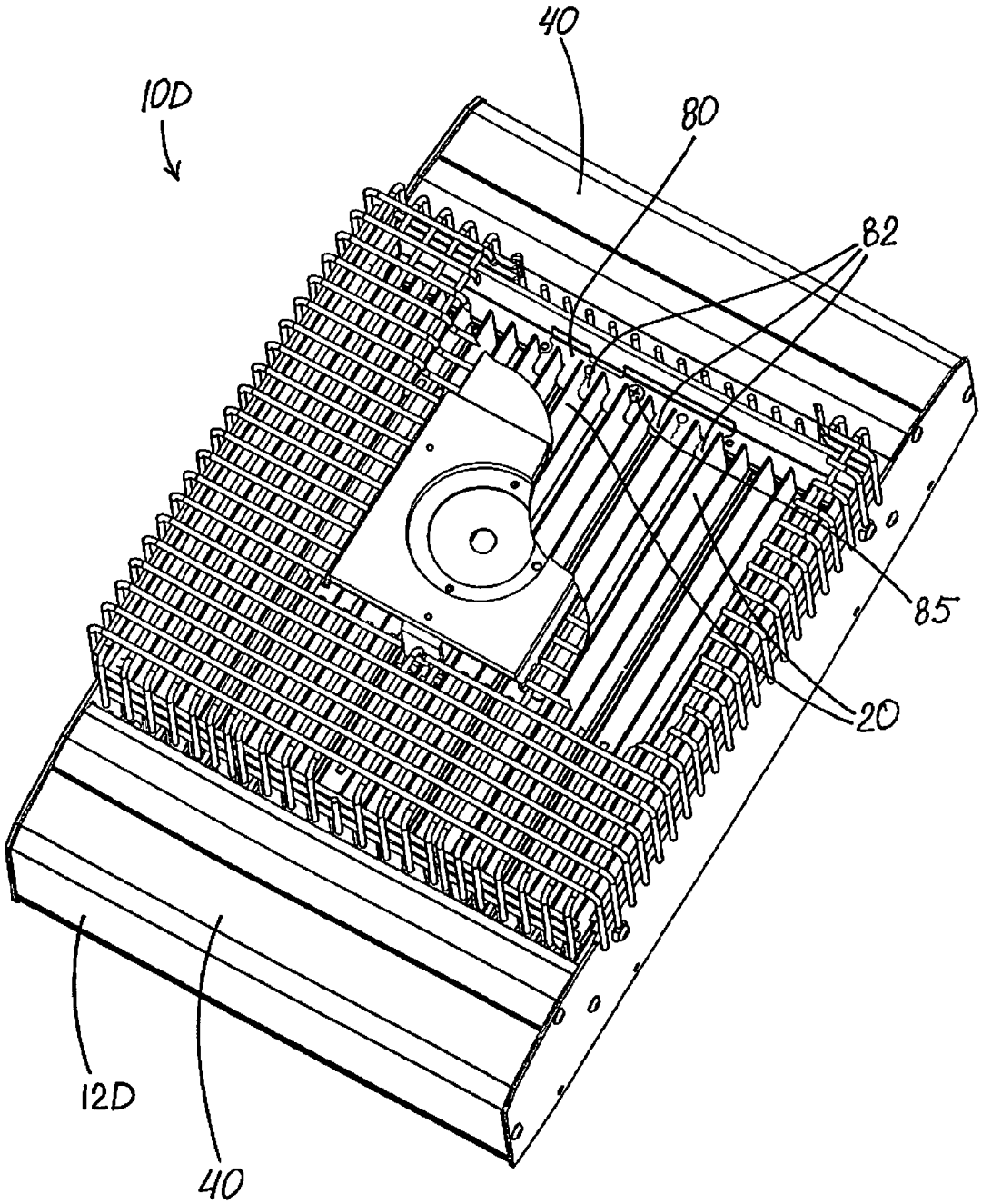
FIG. 14 is a top perspective view of another embodiment of the LED floodlight fixture including a restraining bracket seen through a cut-away in the protective cover.
Figure 15:
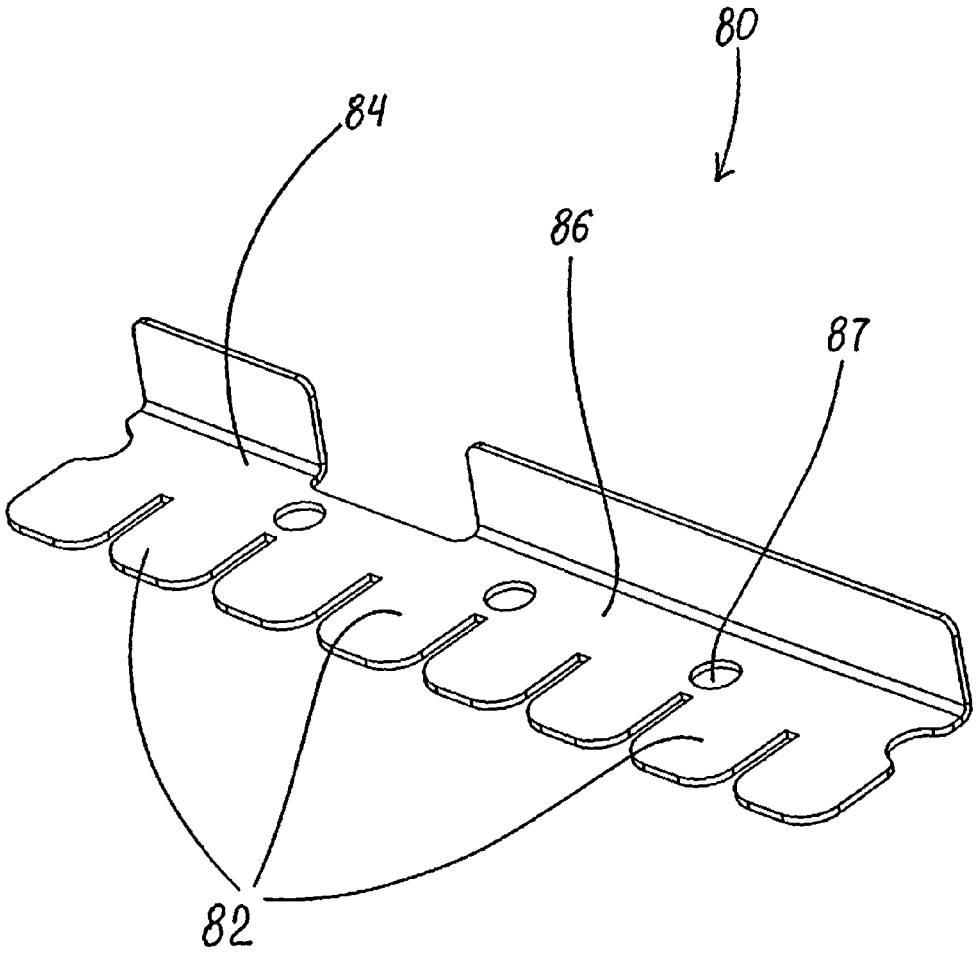
FIG. 15 is a perspective view of the restraining bracket of FIG. 14.

FIG. 14 shows another embodiment of the inventive LED floodlight fixture 10D with housing 12D formed by a pair of opposed border structures 40 and LED assembly 18 secured between border structures 40. Floodlight fixture 10D, as shown on FIG. 14, includes a restraining-bracket 80 secured to housing 12D by screws 85 through screw-holes 87. Bracket 80 has a plurality of projections 82 each of which extends between adjacent fins of two of heat sinks 20. Restraining bracket 80, best shown on FIG. 15, is a comb-like structure with an elongated body 84 including a spine-portion 86 from which the plurality of projections 82 extend. Restraining-bracket 80 is configured and dimensioned for elongated body 84 to be fixedly secured to housing 12 and for projections 82 to snugly fit in spaces between adjacent heat-sink fins.

FIGS. 16-19 illustrate the most preferred embodiment of the present invention. An inventive lighting fixture 120 includes housing 121 having a chamber 124 defined by a surrounding wall 121, at least one power-supply unit 126 within chamber 124, and a slidable interlock 127 securing power-supply unit 126 to surrounding wall 121. Interlock 127 shown in the FIGS. 16-18 includes a linear groove 128 on wall 121 and a mating projection 129 on power-supply unit 126; projection 129 is slidably receivable into groove 128. Power-supply unit 126 is readily secured within chamber 124 by slidable engagement with surrounding wall 121.

Figure 18:
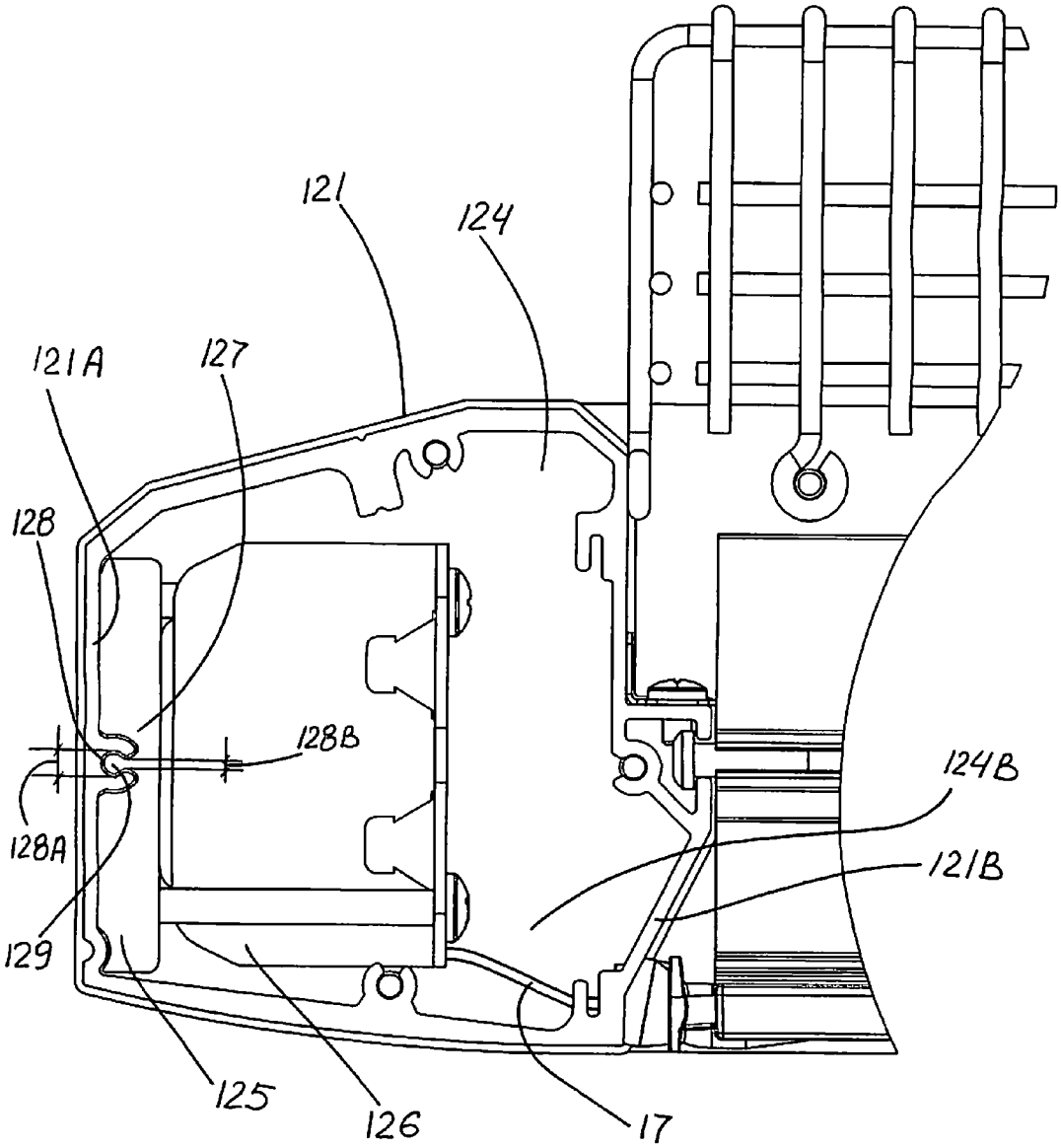
FIG. 18 is an enlarged fragmentary front view of the power-supply unit positioned within the chamber.

As best shown in FIG. 18, groove 128 has an inner cross-dimension 128A greater than its opening cross-dimension 128B; and projection 129 has a distal portion 129A of cross-sectional dimension 129B greater than the groove opening cross-dimension 128B and not greater than groove inner cross-dimension 128A.

Figure 16:
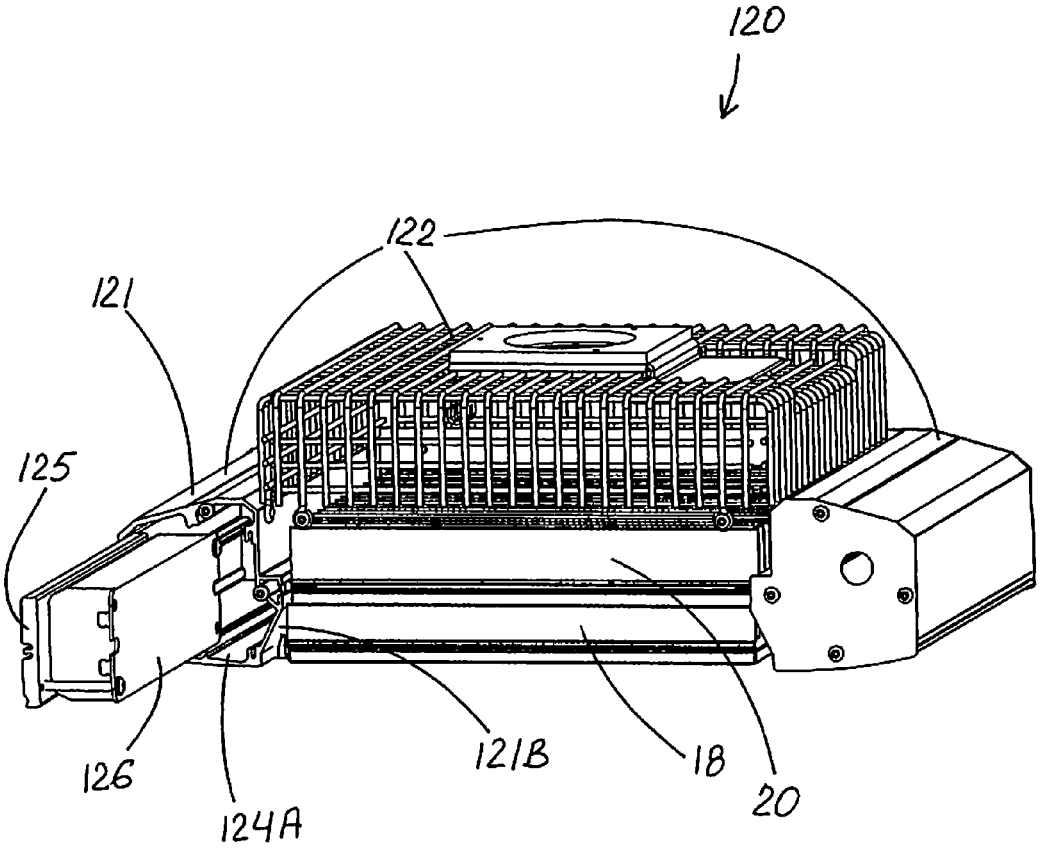
FIG. 16 is a perspective view of a lighting fixture of this invention, including a view of a power-supply unit immediately prior to mounting of the power-supply unit within the chamber by insertion through a chamber-access opening.
Figure 17:
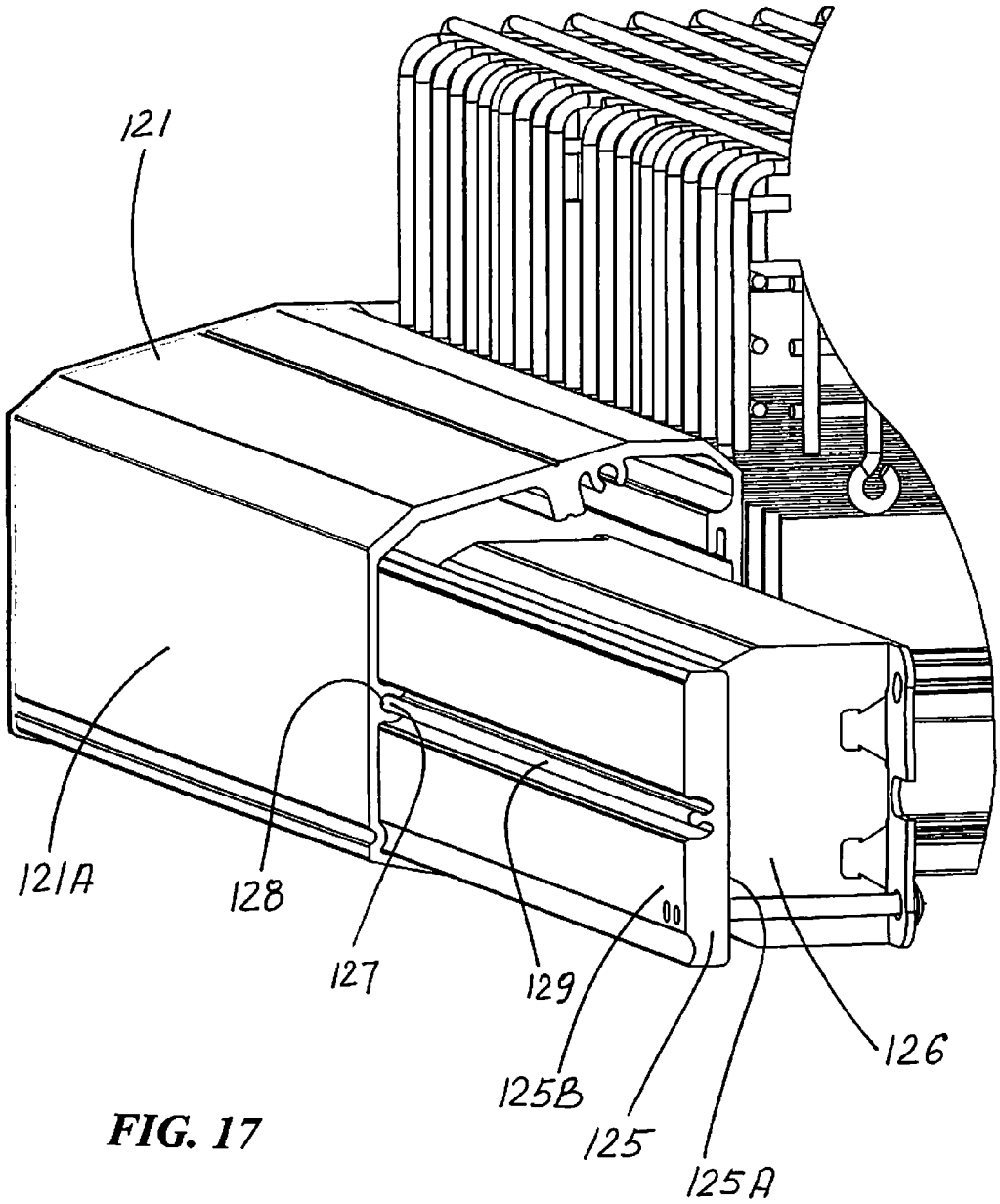
FIG. 17 is an enlarged fragmentary perspective view of the power-supply unit partially inserted into the chamber through the chamber-access opening.

As seen in FIGS. 16-18, surrounding wall 121 has at least one fixture-exterior wall-portion 121A. Power-supply unit 126 is secured closely against fixture-exterior wall-portion 121A, thus facilitating heat transfer from the power-supply unit to outside the fixture.

FIGS. 16-18 further show that surrounding wall 121 further defines a chamber-access opening 124A through which power-supply unit 126 is slidably positioned into chamber 124 for secure mounting to surrounding wall 121.

Inventive lighting fixture 120 further includes a mounting member 125 affixed to power-supply unit 126. Mating projection 129 is shown to be on mounting member 125. Thus, power-supply unit 126 is secured to surrounding wall 121 by mounting member 125.

Mounting member is a heat sink having a first surface 125A affixed closely against power-supply unit 126. Mating projection 129 is on a second surface 125B of the heat sink 125. Second surface 125B is secured closely against fixture exterior wall-portion 121A, thus transferring heat from power-supply unit 126 outside fixture 120.

In the most highly preferred embodiments of the inventive lighting fixture, the chamber is substantially water/air-tight. As best seen in FIG. 16, fixture 120 is shown to be of the same type as improved LED floodlight fixture 10D. Power-supply unit 126 is an electronic LED driver 16. Fixture 120 preferably includes LED assembly 18 secured with respect to housing 122 adjacent thereto in non-water/air-tight condition. LED assembly 18 preferably has at least one LED-array module 19 mounted on LED heat sink 20.

FIGS. 16-18 further show that surrounding wall 121 further has a plurality of wall-portions, including an LED-assembly-adjacent wall-portion 121B which defines a water/air-tight wire-access(s) 44 that receives wires 17 from LED assembly 18 into chamber 124. Power-supply unit 126 is secured to a wall-portion opposite LED-assembly-adjacent wall-portion 121B, which allows a sufficient wire-manipulation space 124B between power-supply unit 126 and wire-access(s) 44. Power-supply unit 126 is secured to fixture-exterior wall-portion 121A, thereby facilitating transfer of heat from power-supply unit 126 to outside of fixture 120.

FIGS. 16-19 further illustrate a method for mounting lighting-fixture power-supply unit 126. FIG. 17 best shows the steps of slidably engaging linear groove 128 and mating projection 129 and securing power-supply unit 126 within chamber 124 by slidable engagement with surrounding wall 121.

FIG. 16 illustrates how the slidably engaging step begins at chamber-access opening 124A. FIGS. 16 and 17 show power-supply unit 126 being slidably positioned into chamber 124 through chamber-access opening 124A.

Figure 19:
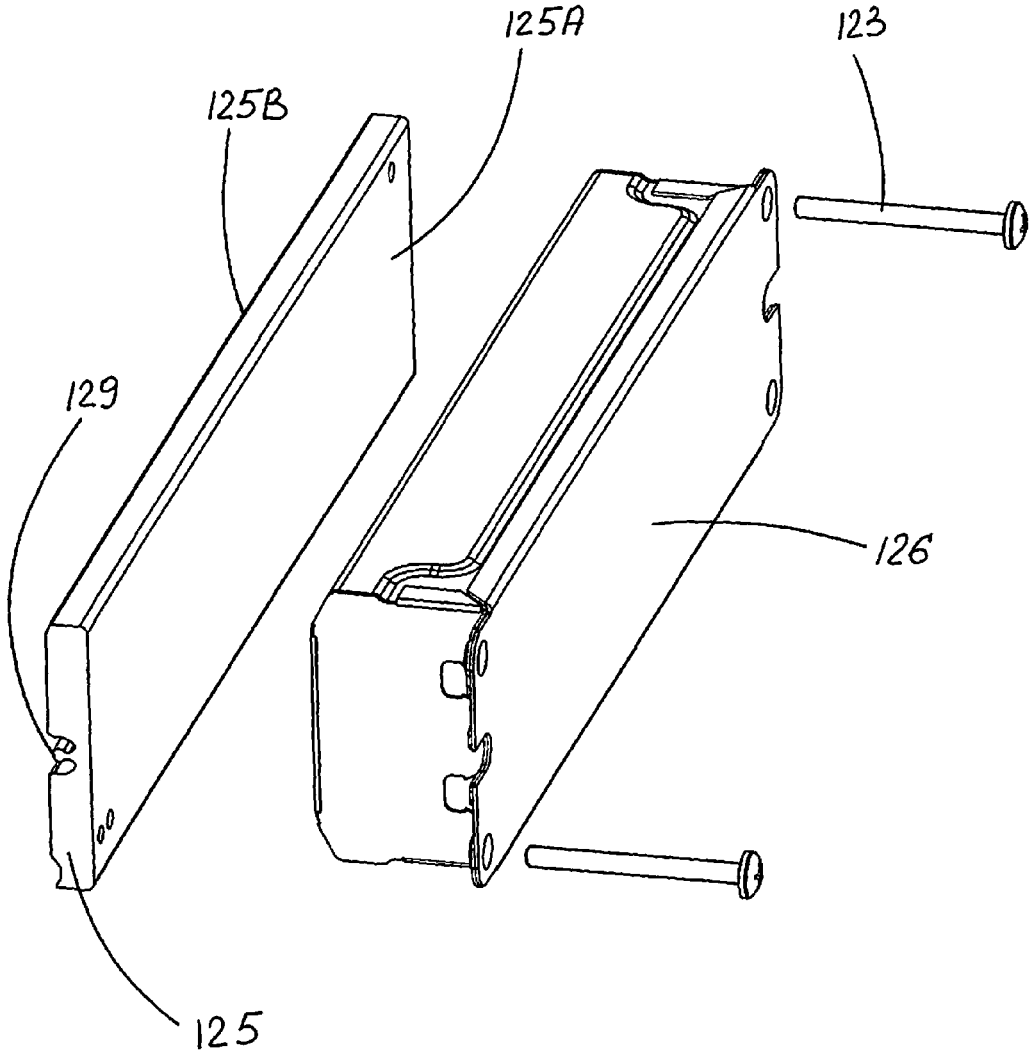
FIG. 19 is an exploded perspective view of a power-supply unit and a mounting member.

FIG. 19 shows mounting member 125 with mating projection 129 on mounting member 125. FIG. 19 further illustrates affixing of mounting member 125 to power-supply unit 126 with fasteners 123. Fasteners 123 may be of any suitable type, such as screws, bolts or any other suitable device for fastening.

While the principles of the invention have been shown and described in connection with specific embodiments, it is to be understood that such embodiments are by way of example and are not limiting.

The invention claimed is:

1. An LED lighting fixture comprising:

a housing having a substantially closed chamber defined by a surrounding wall;

at least one power-supply unit within the chamber, the power-supply unit being an electronic LED driver; and a slidable interlock securing the power-supply unit to the surrounding wall, the interlock including (a) a linear groove on one of the power-supply unit and the wall, and (b) a mating projection on the other of the power-supply unit and the wall and slidably receivable into the groove, whereby the power-supply unit is readily securable within the chamber by slidable engagement with the surrounding wall.

2. The lighting fixture of claim 1 wherein:

the groove has an inner cross-dimension greater than its opening cross-dimension; and the projection has a distal portion of cross-sectional dimension greater than the groove opening cross-dimension and not greater than the groove inner cross-dimension.

3. The lighting fixture of claim 1 wherein:

the surrounding wall has at least one fixture-exterior wall-portion; and the power-supply unit is secured closely against the fixture-exterior wall-portion, thus facilitating heat transfer from the power-supply unit to outside the fixture.

4. The lighting fixture of claim 1 wherein the surrounding wall further defines a chamber-access opening through which the power-supply unit is slidably positioned into the chamber for secure mounting to the surrounding wall.

5. The lighting fixture of claim 1 wherein a mounting member is affixed to the power-supply unit, one of the linear groove and the mating projection being on the mounting member.

6. The lighting fixture of claim 1 wherein the LED fixture includes an LED assembly secured with respect to the housing adjacent thereto in non-water/air-tight condition, the LED assembly having at least one LED-array module mounted on an LED heat sink.

7. The lighting fixture of claim 6 wherein the surrounding wall has a plurality of wall-portions, including an LED-assembly-adjacent wall-portion which defines a water/air-tight wire-access(s) receiving wires from the LED assembly into the chamber.

8. The lighting fixture of claim 7 wherein the power-supply unit is secured to a wall-portion opposite the LED-assembly-adjacent wall-portion allowing a sufficient wire-manipulation space between the power-supply unit and the wire-access(s).

9. The lighting fixture of claim 8 wherein the power-supply unit is secured to a fixture-exterior wall-portion transferring heat from the power-supply unit outside the fixture.

10. The lighting fixture of claim 6 wherein the housing includes at least two structures, including a first structure forming a first portion of the chamber receiving wires from the at least one LED-array module and the LED heat sink being interlocked with the first structure.

11. The lighting fixture of claim 10 wherein the housing is a perimetrical structure and the water/air-tight chamber substantially surrounds the LED assembly.

12. The lighting fixture of claim 11 wherein the perimetrical structure is substantially rectangular and further includes a second, third and fourth structures, all four structures being successively connected to substantially surround the LED assembly.

13. A lighting fixture comprising:

a housing having a chamber defined by a surrounding wall, the surrounding wall having at least one fixture-exterior wall-portion;

at least one power-supply unit within the chamber;

a mounting member affixed to the power-supply unit, the mounting member being a heat sink having a first surface affixed closely against the power-supply unit; and a slidable interlock securing the power-supply unit to the surrounding wall, the interlock including (a) a linear groove on one of the power-supply unit and the wall, and (b) a mating projection on the other of the power-supply unit and the wall and slidably receivable into the groove, one of the linear groove and the mating projection being on a second surface of the heat sink, the second surface being secured closely against the fixture exterior wall-portion, thus transferring heat from the power-supply unit outside the fixture, whereby the power-supply unit is readily securable within the chamber by slidable engagement with the surrounding wall.

14. The lighting fixture of claim 13 wherein the chamber is substantially water/air-tight.

15. The lighting fixture of claim 14 wherein the fixture is an LED lighting fixture with the power-supply unit being an electronic LED driver.

16. A method for mounting an LED lighting-fixture power-supply unit:

providing a lighting-fixture housing having a substantially closed chamber defined by a surrounding wall;

providing a slidable interlock including (a) a linear groove on one of the power-supply unit and the wall and (b) a mating projection on the other of the power-supply unit and the wall and slidably receivable into the groove, the power-supply unit being an electronic LED driver;

slidably engaging the linear groove and the mating projection; and securing the power-supply unit within the chamber by the slidable engagement with the surrounding wall.

17. The method of claim 16 wherein:

the groove has an inner cross-dimension greater than its opening cross-dimension; and the projection has a distal portion sized for the groove inner cross-dimension but being greater than the groove opening cross-dimension.

18. The method of claim 16 wherein:

the surrounding wall has at least one fixture exterior wall-portion; and the power-supply unit is secured closely against the fixture exterior wall-portion, thus transferring heat from the power-supply unit outside the fixture.

19. The method of claim 16 wherein:

the surrounding wall further defines a chamber-access opening;

the slidably engaging step begins at the chamber-access opening; and the power-supply unit is slidably positioned into the chamber through the chamber-access opening.

20. The method of claim 16 further including steps of:

providing a mounting member with one of the linear groove and the mating projection being on the mounting member; and affixing the mounting member to the power-supply unit.

21. The method of claim 20 wherein:

the surrounding wall has at least one fixture exterior wall-portion;

the mounting member is a heat sink having a first surface affixed closely against the power-supply unit; and one of the linear groove and the mating projection being on a second surface of the heat sink, the second surface being secured closely against the fixture exterior wall-portion, thus transferring heat from the power-supply unit outside the fixture.

* * * * *